US007029491B2

(12) United States Patent
Davis

(10) Patent No.: US 7,029,491 B2
(45) Date of Patent: Apr. 18, 2006

(54) PACIFIER

(76) Inventor: John J. Davis, 35 Deerfield Rd., Troutville, VA (US) 24175

( * ) Notice: Subject to any disclaimer, the term of this patent is extended or adjusted under 35 U.S.C. 154(b) by 56 days.

(21) Appl. No.: 10/396,424

(22) Filed: Mar. 26, 2003

(65) Prior Publication Data

US 2006/0036285 A1 Feb. 16, 2006

(51) Int. Cl.
*A61J 17/00* (2006.01)

(52) U.S. Cl. ..... 606/234; 606/236

(58) Field of Classification Search ..... 606/234–236; D24/194–196

See application file for complete search history.

(56) References Cited

U.S. PATENT DOCUMENTS

| | | | |
|---|---|---|---|
| 3,924,621 | A | 12/1975 | Cassimally |
| 4,132,232 | A | 1/1979 | Lerner |
| 4,909,253 | A | 3/1990 | Cook et al. |
| 5,004,473 | A | 4/1991 | Kalantar |
| 5,133,740 | A | 7/1992 | Kussick |
| 5,334,218 | A | 8/1994 | Johnson |
| D380,269 | S | 6/1997 | Mendes |
| D390,962 | S | 2/1998 | Hohl |
| 5,814,074 | A | 9/1998 | Branam |
| 5,843,030 | A | 12/1998 | Van Der Merwe |
| 5,922,010 | A | 7/1999 | Alanen et al. |
| 6,080,186 | A | 6/2000 | Pedersen et al. |
| 6,203,566 | B1 | 3/2001 | Alanen et al. |
| 6,454,788 | B1 | 9/2002 | Ashton |
| 2002/0055760 | A1 | 5/2002 | Avital |

OTHER PUBLICATIONS

Zardetto et al., "Effects of different pacifiers on the primary dentition and oral myofunctional structures of preschool childern", Pediatric Dentistry—24:6, pp. 552-560 (2002).

*Primary Examiner*—Julian W. Woo
(74) *Attorney, Agent, or Firm*—Stevens, Davis, Miller & Mosher, LLP

(57) ABSTRACT

A pacifier includes a nipple, a shield and a handle. The nipple comprises a pair of wings extending longitudinally along a bulbous end of the nipple. The wings allow for air to exit and enter the space between the palate and the nipple to prevent a vacuum therebetween. Alternatively, the nipple has a channel system comprising a series of holes on the surface of the nipple, some contacting the palate, to also allow the air to enter and exit the space between the palate and the nipple. The stem of the nipple may also have a transverse hole which receives the baby teeth to prevent an open bite.

36 Claims, 7 Drawing Sheets

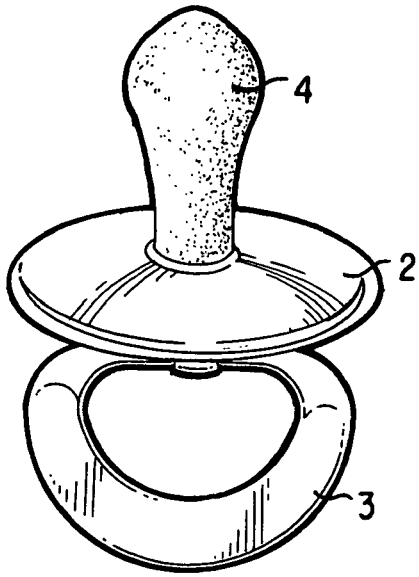
FIG. 1A
FIG. 1B
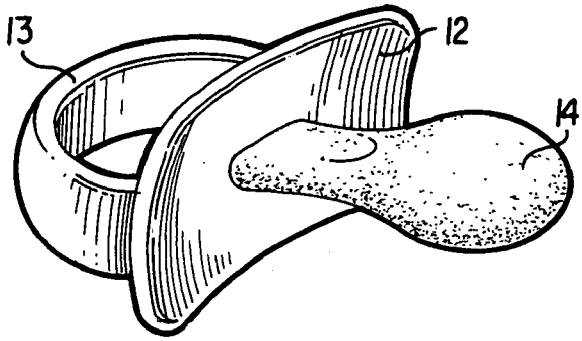
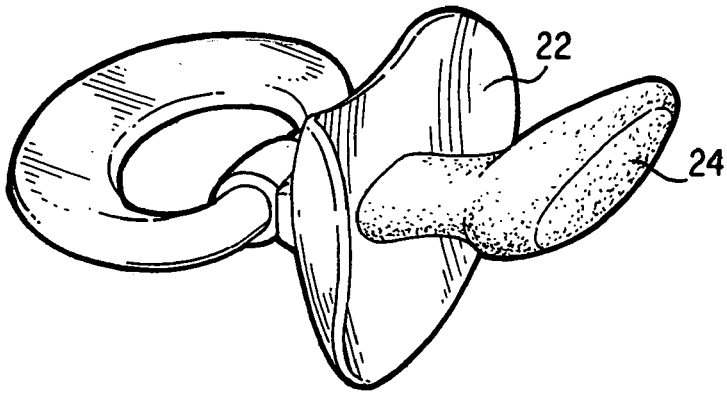
FIG. 1C

PACIFIER

FIELD OF THE INVENTION

The principal utility of the invention relates to pacifiers for infants who still have the natural sucking instinct or urge.

BACKGROUND OF THE INVENTION

From birth, infants have a natural sucking instinct or urge. This phenomenon is essential for the infants' survival, for it allows them to feed from the infant's mother's breast a short time following birth. However, if the sucking urge is not gratified, the infant will generally have a remaining urge that may lead either to frustration if the urge is not satisfied or the infant will lose the urge. A common practice to ease the frustration of the sucking urge is for the infant to engage in a non-nutritional sucking where the infant will suck a thumb, finger, or pacifier. Such acts may satisfy the urge. As a result of the satisfaction, such acts may provide a source of pleasure, self-gratification, comfort, and soothing relaxation. As the infant grows, the sucking urge is gradually replaced by mastication.

The use of a pacifier as a means to satisfy the sucking urge has been used for many centuries. In early pacifiers, the pacifiers were made of a cloth or chamois into which bread crumbs or sugar were placed and then were tied into the shape of a nipple. The end would be moistened and introduced in the infant's mouth. These simple devices over the years have evolved into the modern day pacifier, examples of which are shown in FIGS. 1A–1C.

Early conventional pacifiers, as shown in FIG. 1A, have a more cherry like nipple 4 and a convex shield 2 to conform to the infant's face. Physiological pacifiers, shown in FIGS. 1B and 1C have features that conform more to the infant's physical features. For example, the shields 12 and 22 have a concave shape that conforms more to the infant's face. Further, the nipples, 14 and 24, have designs to coexist with the infant's inter-oral structures, such as flattened to fit between the infant's teeth (shown in FIG. 1B) or an indented nipple to allow room for the infant's tongue (shown in FIG. 1C).

A problem associated with the use of these pacifiers is that after prolonged use, they begin to affect the development of or change the structure of the infant's oral cavity. Without the pacifier, thumb, finger, etc. in the mouth, the tongue naturally exerts a positive pressure in the mouth, namely a pressure pushing out against the alveolar ridges and the teeth. Such positive pressure spurs inter-canine and inter-molar distance growth of the teeth as well as spurs expansion of the width of the alveolar ridges.

When an infant sucks on one of these pacifiers, the top of the pacifier conforms to the roof of the infant's mouth, or palate, causing a negative pressure that is directed towards the midline of the roof of the child's mouth, or palate, and is exerted on the teeth and the bone surrounding the teeth, or the alveolar ridge, in the region of the upper deciduous canines and molar teeth. Such is shown in FIGS. 2A–2C. A conventional pacifier nipple 4 is placed into an infant's mouth, between a palate 8 having two sides, 5 and 6, about a center line CL, and a tongue 7. As tongue 7 moves upward during a sucking action, nipple 4 is compressed between the tongue and palate 8, forming a tremendous vacuum between the palate 8 and the pacifier 4. As tongue 7 moves down in the mouth during a sucking action, the vacuum pulls on palate sides 5 and 6 towards the centerline of palate 8, collapsing them inward. This pulling has an adverse effect on the inter-canine and inter-molar growth distance of the upper jaw, causing them to either move toward centerline CL of palate 8 or preventing the palate's natural growth outward, which can cause a cross bite, meaning the upper teeth bite on the inside of the lower teeth. This pulling can also cause the alveolar ridge, which generally has a horse shoe shape, to have a narrower width than normal. These adverse effects can overcome the natural growth caused by positive pressure from the tongue.

Other pacifiers have attempted to overcome the negative pressure created by the conventional pacifiers and re-create the tongue pressure, such as the pacifier disclosed in U.S. Pat. No. 5,922,010 (Alanen et al.), incorporated herein by reference in its entirety. In this pacifier, the nipple has a generally vertically concave shape, which contacts between the alveolar ridge near the base of the deciduous teeth on each side of the baby's mouth and the baby's tongue. During a baby's sucking action, the pressure applied by the tongue against the pacifier is transferred directly against the alveolar ridge and deciduous teeth to push them outward. However, the disadvantage of this pacifier is that with overuse of this pacifier, or use by an infant that did not need such a pacifier, the pressure pushing out on the teeth and alveolar ridge would cause a lateral horizontal gap between the posterior upper teeth and posterior lower teeth. This pacifier, as disclosed by Alanen et al., is more of a functional appliance, which moves bone.

Another problem associated with these pacifiers is that when the tongue is pulled back during a sucking action, the pressure that was created between the tongue and pacifier as well as between pacifier and palate pulls on the soft tissue of the palate which will in turn pull on the bone of the palate. Eventually, the palate will begin to collapse which can cause a crossbite.

A further problem associated with pacifiers is that they prevent the ordinary growth of the front teeth. The teeth ordinarily erupt until they meet an opposing force to prevent further growth, which is generally the opposing teeth. When a pacifier is placed between the front teeth, the jaw is effectively propped open. When the jaw is propped open for extended periods of time, the posterior molars continue to erupt while the front teeth are prevented from erupting because of the pacifier, which leads to an open bite where there is a vertical gap between the front teeth or a large overjet. After the infant reaches the age of two, the open bite is difficult to correct.

SUMMARY OF THE INVENTION

It is therefore an object of the invention to provide a pacifier that avoids the problems mentioned above. It is also an object of the invention to provide a pacifier that prevents any suction force between the palate and the pacifier as well as the palate and the tongue.

These and other objects obvious to a person having ordinary skill in the art are overcome in a pacifier comprising a nipple having a stem portion and a bulbous portion, which has two wings laterally arranged on a central support portion. The stem portion is attached to a shield of the pacifier. Typically, the nipple is made of a resilient or elastic compressible material, for example, plastic, medical grade rubber, silicone rubber, latex or other conventional pacifier material. In particular, the wings are made of such resilient or elastic compressible material and are solid or are hollow but filled with air, liquid or gel. The central support portion is solid or hollow with an optional vent through the shield. A longitudinal channel lies between the wings.

Pressure on the nipple by the infant's tongue can cause the wings to pivot apart slightly. The open channel prevents the vacuum pressure commonly caused by conventional nipples to prevent damage to the palate and thus prevent bite abnormalities in the infant's mouth, or malocclusion. The open channel has a curved shape such that at least a portion of each wing contacts the midline of the palate. In the alternative, the open channel may be straight but since the wings spread only slightly, at least a portion of each wing contacts contact the middle section of the palate that, for purposes of this specification, is defined as the middle third section of the palate flanking the midline of the palate.

In another embodiment, the pacifier has a nipple attached to the shield wherein a longitudinal channel passes through the nipple and at least one vertical channel extends from the longitudinal channel and extends to the surface of the nipple. The channels passing through the nipple prevent the vacuum pressure caused by conventional nipples. There may also be additional lateral channels extending from the longitudinal channel and out of the nipple for additional pressure release. A portion of the nipple contacts the midline of the palate. Thus, for example, if two or more vertical channels are provided, the vertical channels have spaces between them so that a portion of the nipple contacts the midline of the palate. The nipple may be made of the above-described resilient or elastic compressible material which is solid or is hollow but filled with air, liquid or gel.

In a further embodiment, the anterior part of the pacifier forms a neck which abuts the infant's teeth in premaxilla and has a transverse hole therethrough from the neck's upper surface to its bottom surface. The hole is positioned lingual to the maxillary anterior dentition, but is still positioned over a posterior portion of the pre-maxilla. The hole may contact the lingual surface of the upper interior dentition at rest in the infant's mouth or during functioning of the pacifier when the child exerts pressure on the nipple placed in the infant's mouth. The transverse hole also works with the longitudinal channel to provide a release of suction pressure from the tongue or palate and to directly relieve pressure from the anterior palate and/or premaxilla.

BRIEF DESCRIPTION OF THE DRAWINGS

Other embodiments, features and advantages of the invention described herein will occur to those skilled in the art from the following description of a preferred embodiment and the accompanying drawings, in which:

FIGS. 1A–1B illustrate perspective views of conventional pacifier designs;

DETAILED DESCRIPTION OF THE INVENTION

Figure 2A:
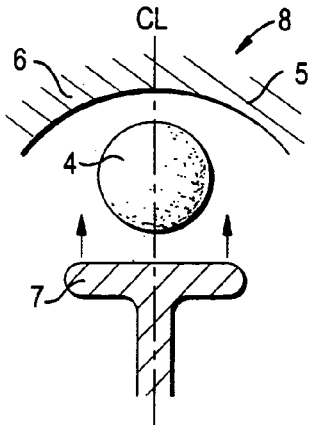
FIGS. 2A–2C illustrate a sucking process using a conventional pacifier.

A first embodiment of the invention is shown in FIGS. 3–6. A pacifier 100 has a ring 110 for holding the pacifier, a shield 120 and a nipple 200 shown lying at least partly along a longitudinal axis "L". Ring 110 generally has a circular shape which is threaded through a post 111, however, any structure that allows for grabbing pacifier 100 without having to contact nipple 200 would work sufficiently. Ring 110 and post 111 may also be replaced entirely by a simple rod handle design, such as rod handle 3 of FIG. 1A or a wider version of the rod, such as handle 13 shown in FIG. 1B.

Shield 120 as shown in FIGS. 3–6 has a flat shape, however, the concave or convex shapes shown in FIGS. 1A–1C would also work.

Figure 3:
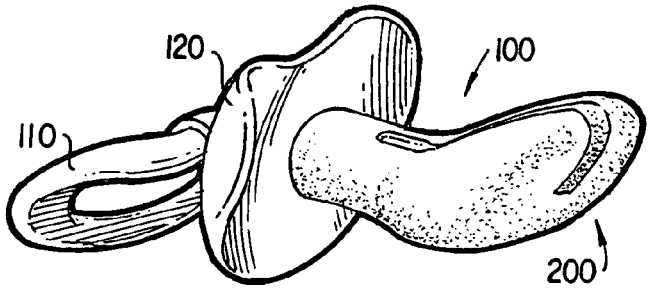
FIG. 3 illustrates a pacifier according to a first embodiment of the invention.
Figure 4:
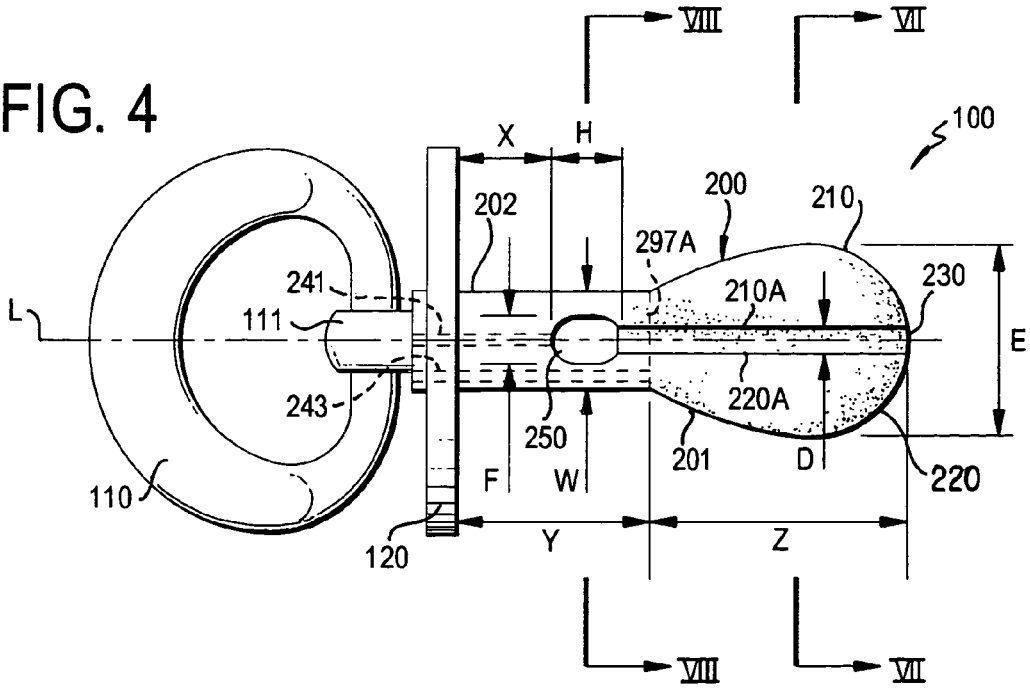
FIG. 4 illustrates a top view of the pacifier shown in FIG. 3.
Figure 5:
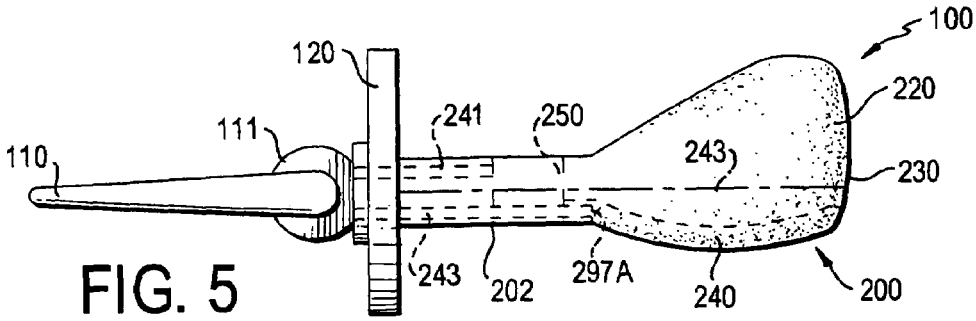
FIG. 5 illustrates a side view of the pacifier shown in FIG. 3.

As shown in FIGS. 3–5, nipple 200 has a generally bulbous shape extending away from shield 120. It comprises a stem portion 202 and a larger rounded head portion 201. In use of the pacifier 100, a baby places its lips around stem portion 202 of nipple 200 and in an abutting relationship with shield 120. In conjunction with the lip placement, the larger head portion 201 of nipple 200 helps prevent pacifier 100 from falling out of the baby's mouth, even when no sucking action is taking place.

Figure 6:
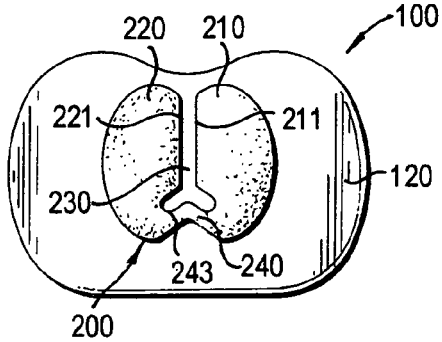
FIG. 6 illustrates a front view of the pacifier shown in FIG. 3.
Figure 7:
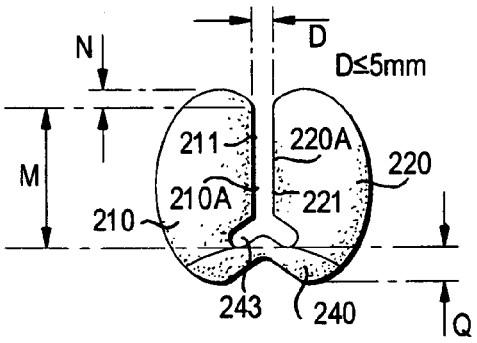
FIG. 7 illustrates a cross sectional view of the pacifier shown in FIG. 4 along line VII—VII.
Figure 8:
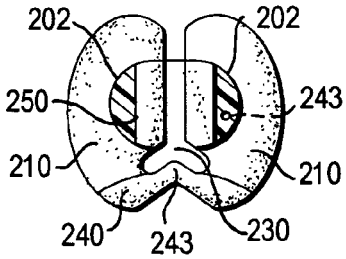
FIG. 8 illustrates a cross sectional view of the pacifier shown in FIG. 4 along line VIII—VIII.

Nipple 200 has two laterally spaced wings, 210 and 220, which divides the nipple generally into two halves. Wings 210, 220 extend from a support portion 240 located along the bottom of nipple 200. The combination of wings 210 and 220 and support portion 240 form generally a U-shape, as shown in FIGS. 6–8. The wings 210, 220 have adjacent opposed longitudinal side walls 211, 221 defining a longitudinal channel 230 therebetween in an at rest position shown in FIG. 4. The longitudinal channel 230 is defined by longitudinal side walls 211, 221 and a bottom wall 241. At their nearest point to each other the longitudinal sidewalls 211, 221 are 0 to 3 mm apart at rest. The bottom wall 243 may be provided by support portion 240 as shown in FIGS. 7 and 8 or by having a portion of the wings 210, 220 extend under the longitudinal channel 230 as shown in FIG. 13B. Typically, middle portions 210A, 220A of the opposed longitudinal side walls 211, 221 are abutting or adjacent to be apart a distance "D" (FIGS. 4 and 7) from 0 to about 3 mm, preferably 0 to about 2 mm, typically about 0.5 mm to about 2 mm, in the at rest (not in use) position. Measurement "D" is defined as the minimum distance between the opposed longitudinal side walls 211, 221 in the at rest position.

In use, when the child sucks on the pacifier 100, the opposed middle portions 210A, 210B of the opposed longitudinal sides typically spread an additional 0 to 3 mm such that there is typically a minimum spacing of about 0.5 to about 6 mm between the opposed middle portions 210A, 210B of the opposed longitudinal sides.

Figure 10:
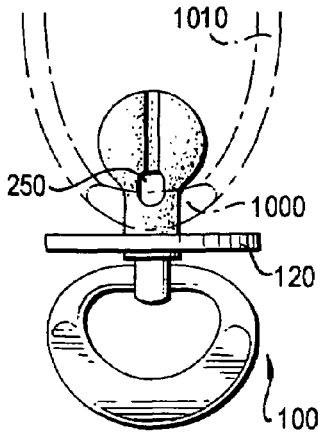
FIG. 10 illustrates a top view of the pacifier shown in FIG. 3 having an operation position with respect to an infant.

As shown by FIGS. 4 and 5, the neck (stem) 202 of the pacifier 100 has a transverse hole 250 passing through the stem 202 from a top side of the nipple to the bottom side, as shown in FIGS. 4 and 5. The transverse hole 250 is located in a position that would normally contact the infant's teeth in pre maxilla, which is shown in FIG. 10. FIG. 10 shows the location of transverse hole 250 in relation to an infant's mouth, specifically an upper jawbone, or the maxilla. On either side of the upper jawbone are palatal shelves 1010. At the front of the upper jawbone is the pre-maxilla 1000, from where the front teeth erupt in infants. As shown in FIG. 4, the transverse hole 250 is a distance "X" from the shield 120 to be positioned lingually to the primary maxillary anterior dentition, but not so far lingual that it avoids contact with a portion of the premaxilla. Typical distance "X" ranges from about 3 mm to about 9 mm, for example about 6 mm.

Some other typical dimensions of the pacifier 100 of FIGS. 4 and 5 are as follows: Y equals about 1 cm to about 3 cm, for example about 2 cm; Z equals about 1.2 cm to about 2.2 cm, for example about 1.5 cm; E equals about 1.3 cm to about 2.3 cm, for example about 1.8 cm; F equals about 5 mm to about 11 mm, for example about 8 mm; W equals about 8 mm to about 15 mm, for example about 12 mm; and G equals about 3 mm to about 9 mm, for example about 6 mm.

FIG. 7 shows some other typical dimensions of the pacifier 100, namely: "M", which is the height from a shoulder of the longitudinal side wall 211, 221 to the location where the longitudinal side wall 211, 221 joins the lower wall 243, of about 5 to about 10 mm; "N" which is the height from the shoulder of the longitudinal side wall 211, 221 to the uppermost surface of the nipple 200 at rest, of about 1 to about 4 mm; and "Q" which is the height from the location where the longitudinal side wall 211, 221 joins the lower wall 243 to the lowermost surface of the nipple 200 at rest, of about 1 to about 4 mm.

The wings 210, 220 and the support portion 240 are typically a unitary structure of a single piece of a single material (although the single material may optionally have hollow chambers as described below filled with air, liquid or gel). However, if desired the wings 210, 220 and the support portion 240 may be made of respective pieces of the same or different materials fused together. The material of wings 210, 220 and support portion 240 should be of a soft but durable material, such as rubber, a soft plastic or other soft polymer. Typically, the wings 210, 220 and support portion 240 are made of a resilient or elastic compressible material, for example, plastic, medical grade rubber, silicone rubber, latex or other conventional pacifier material. Wings 210, 220 and/or the support portion 240 may be solid or they may be hollow and filled with air, liquid, such as water, or a gel. FIGS. 4 and 5 show solid wings 210, 220 and a hollow support portion 240. If the wings 210, 220 or support portion 240 were hollow and filled with liquid or gel, the design should be such that the liquid or gel cannot be released. If the wings 210, 220 were hollow and filled with air they would typically be designed such that the air cannot be released.

The materials used and the structure for the wings 210, 220 and support portion 240 should be chosen to provide a compressible pacifier that would be comfortable and safe to hold in a baby's mouth. Such structures and materials allow the wings 210, 220 and support portion 240 to be compressed and thereafter expanded during a sucking action.

The stem 202 may be hollow or solid. FIGS. 4 and 5 show the pacifier 100 having a solid stem 202. When the stem 202 is solid, a vent passageway 241 may optionally be provided through shield 120 that communicates the air outside the shield to the transverse hole 250.

If the support portion 240 is a hollow cavity filled with air, a vent passageway 243 (FIG. 5) may optionally be provided through shield 120 and interior end wall 297A to communicate the air outside the shield 120 to the anterior portion of support portion 240. This allows air to move in from outside the baby's mouth and into support portion 240 and allows air to exit from the support portion 240 outside of the pacifier 100. Such structures and materials allow support portion 240 to be compressed and thereafter expanded during a sucking action.

Figure 5A:
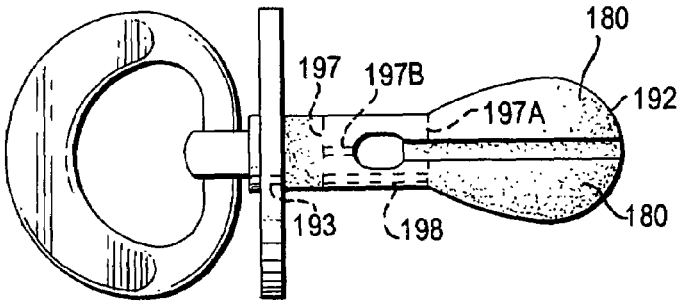
FIG. 5A illustrates a top view of a second embodiment of the pacifier of the invention.
Figure 5B:
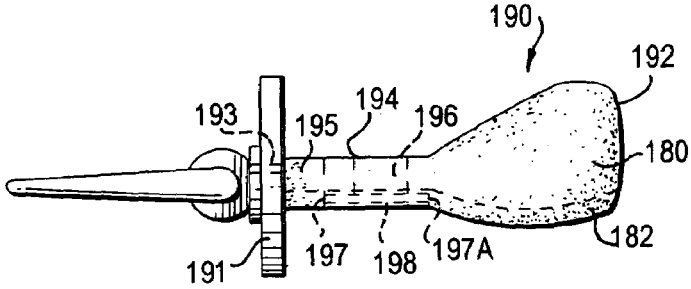
FIG. 5B illustrates a side view of the pacifier shown in FIG. 5A.

FIGS. 5A and 5B show an embodiment of a pacifier 190 which has a nipple 192 having solid wings 180 and a hollow support portion 182. Pacifier 190 is generally of the same structure as the embodiment of FIG. 5 except its stem 194 has a hollow portion 195 adjacent to a shield 191, and has an optional vent passageway 193 from the hollow portion 195 through the shield 191. The transverse hole 196 may be prevented from communicating with the hollow portion 195 by a wall 197 of solid material between the hole 196 and the hollow portion 195, or an optional vent passageway 197B (FIG. 5B) may be provided to allow air to pass between the transverse hole 196 and outside the pacifier 190. If the support portion 182 is hollow, and filled with air, optionally a vent passageway 198 extending through wall 197 and an endwall 197A may be provided such that the hollow portion 195 communicates with the hollow support portion 182 to permit air to pass into and out of the hollow support portion 182.

Figure 5C:
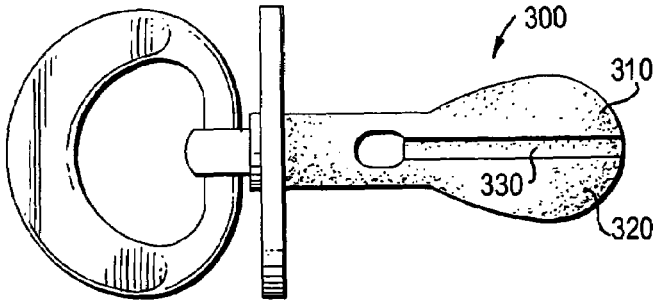
FIG. 5C illustrates a top view of a third embodiment of the pacifier of the invention.
Figure 5D:
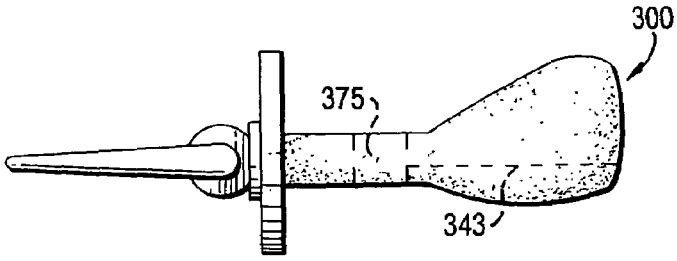
FIG. 5D illustrates a side view of the pacifier shown in FIG. 5C.

FIGS. 5C and 5D show another embodiment of the pacifier 300 of the present invention having a different nipple shape, a transverse hole 375 passing through its stem, and two laterally spaced wings 310, 320 which define a longitudinal channel 330 having a bottom wall 343.

Figure 5E:
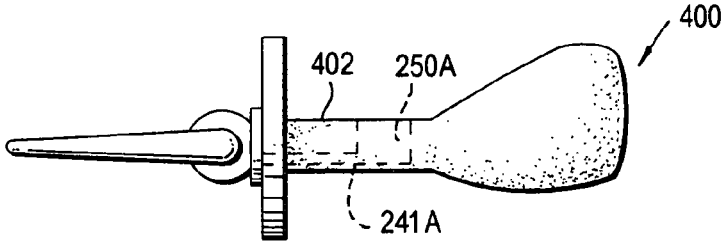
FIG. 5E illustrates a side view of a fourth embodiment of the pacifier of the invention.

FIG. 5E shows an embodiment 400 having the same general structure as the embodiment of FIG. 5 but a transverse hole 250A extends from an opening on the upper side top of the stem portion 202 far enough to communicate with a vent passageway 241A of the stem portion 402, but does not extend completely through the stem portion 402.

Figure 2B:
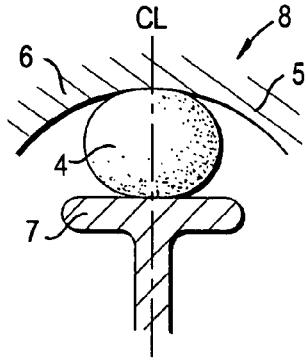
Figure 2C:
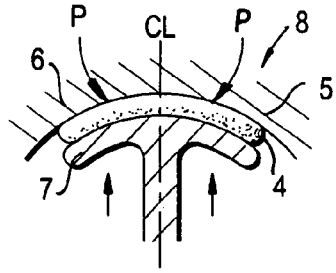
Figure 9A:
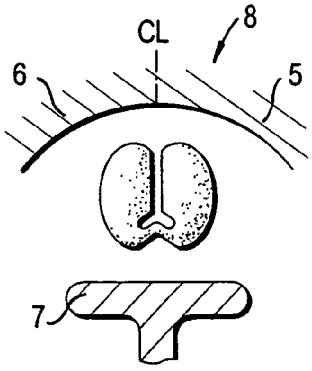
FIGS. 9A–9C illustrate a sucking process using the pacifier shown in FIG. 3.
Figure 9B:
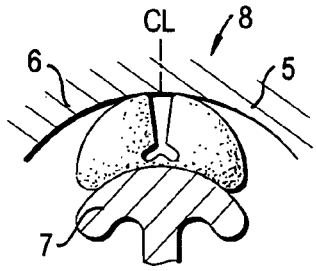
Figure 9C:
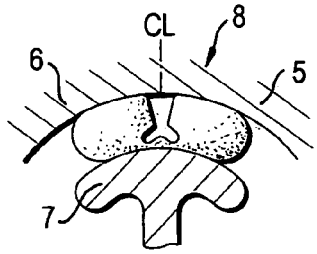

A sucking action using pacifier 100 is shown in FIGS. 9A–9C. Nipple 200 is placed into an infant's mouth, between a palate 8 having two ridges 5 and 6 about a center line CL and a tongue 7, which is shown in FIG. 9A. As tongue 7 moves upward during a sucking action, nipple 200 is compressed between the tongue and palate 8. The compression of nipple 200 causes wings 210 and 220 to expand outwardly away from channel 230, increasing the channel width that allows the air between palate 8 and nipple 200 to move into and out of channel 230. Upon full compression of nipple 200, as shown in FIG. 9C, the width of channel 230 is a maximum. The movement of air in channel 230 prevents a vacuum from forming between palate 8 and nipple 200. Without any vacuum, the damaging pulling effect of conventional pacifiers on the palate ridges 5 and 6, as described above with reference to FIGS. 2A–2C, is effectively prevented.

During use of a conventional pacifier in a sucking action, the infant's teeth clamp down on the nipple stem or would erupt from the pre-maxilla into the nipple stem which causes an open bite over time, as described above. However, the transverse hole 250 in pacifier 100 receives the infant's teeth to allow all of the upper and lower teeth to come closer together than they would if the stem were solid. When the teeth come together evenly, the teeth erupt uniformly from the anterior to the posterior teeth, avoiding the development of an open bite. Moreover, the transverse hole 250 relieves pressure at the beginning of the sucking motion. It removes suction pressure from the premaxilla to avoid the open bite which results from conventional pacifiers.

Figure 11A:
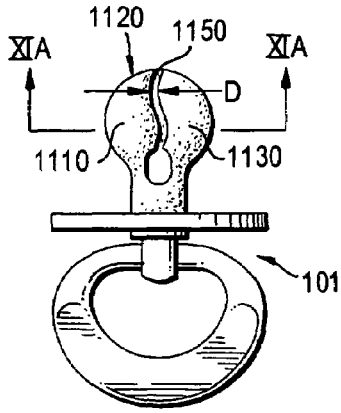
FIG. 11A illustrates a pacifier according to another embodiment of the invention.

In another embodiment of the pacifier, as shown in FIG. 11A, a pacifier 101 having a nipple 1120 has a similar structure as the first embodiment's structure, however, a channel 1150 between a pair of wings 1110, 1130 has a curved design. In other aspects, pacifier 101 operates in a similar fashion as the first embodiment. The wings 1110, 1130 are separated by a distance "D" in the at rest position as described above for the first embodiment.

Figure 11B:
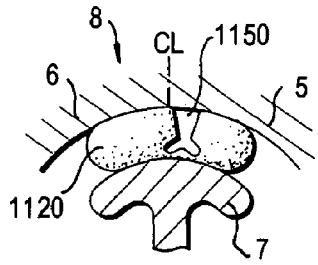
FIG. 11B illustrates a cross section view XIA—XIA of the pacifier nipple shown in FIG. 11A during a sucking action.

Additionally, pacifier 101, via the curved design of channel 1150, allows equal pressure of pacifier 101 against the surface of the palate. As shown in FIG. 11B, when pacifier 101 is in use during a sucking action, tongue 7 presses against the pacifier to collapse the pacifier against palate 8. Note how channel 1150 is offset from the centerline CL of palate 8. At another point of the curved channel 1150, the channel may be located on the other side of centerline CL. Such provides pressure against palate 8 not only at palate sides 5 and 6, but across the entire palate middle section, which will avoid the consequences of pressing against only the sides of palate 8 as described above with reference to the Alanen et al. patent.

While a curved design has been disclosed for pacifier 1120, other shapes may be used, such as a straight line zig-zag pattern, a condensed curve pattern or other patterns that allow for each wing 1110 and 1130 to contact the centerline CL of the palate.

Figure 12:
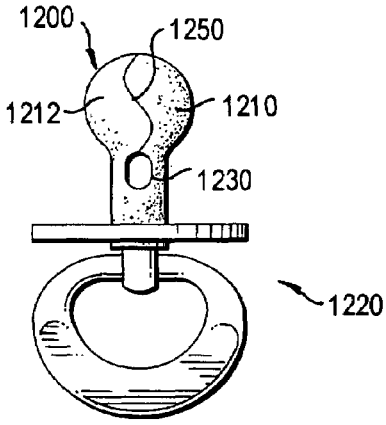
FIG. 12 illustrates a pacifier according to a further embodiment of the invention.

In a further embodiment, rather than provide an open longitudinal channel between wings in the at rest position, a pacifier 1220, which is shown in FIG. 12, has a similar structure and operation as the above embodiments, however a pair of wings 1210, 1220 on a nipple 1200 are in an abutting relationship to define an abutment line 1250 between the wings 1210, 1220 (in other words distance "D" is about zero in the at rest position shown in FIG. 12). The abutment line 1250 may be a straight line, a zig-zag pattern or a curved design which will be described herein. Other patterns for the abutment line are further possible. The abutment line 1250 runs from a transverse hole 1230 to a distal end of nipple 1200.

Figure 13A:
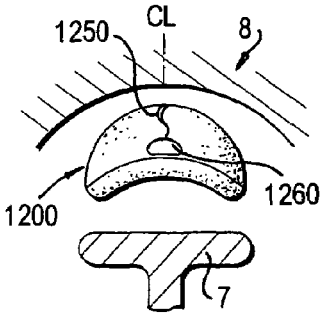
FIGS. 13A–13C illustrate a sucking process using the pacifier shown in FIG. 12.
Figure 13B:
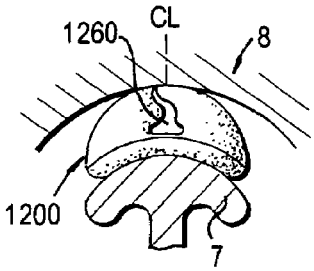
Figure 13C:
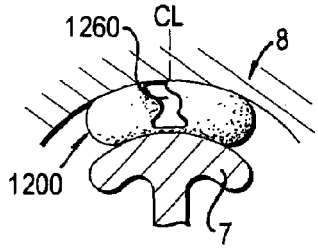
Figure 14A:
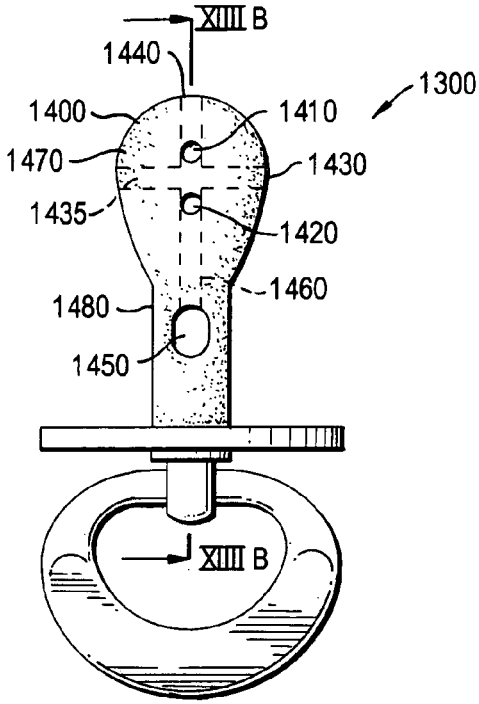
FIG. 14A illustrate a pacifier according to another embodiment of the invention.
Figure 14B:
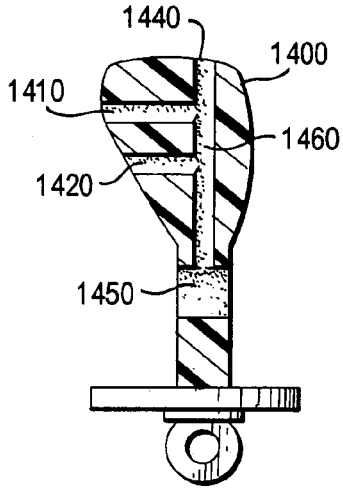
FIG. 14B illustrates a cross sectional view of the pacifier shown in FIG. 14A along line XIIII B—XIIII B.
Figure 14C:
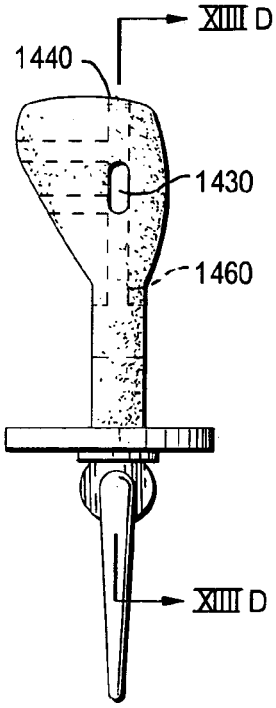
FIG. 14C illustrates a side view of the pacifier shown in FIG. 14A.
Figure 14D:
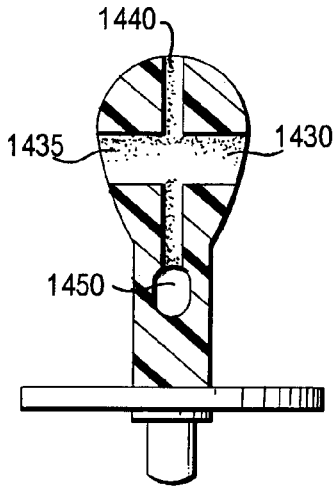
FIG. 14D illustrates a cross sectional view of the pacifier shown in FIG. 14C along line XIIII D–XIIII D.

An operation of pacifier 1220 is shown with respect to FIGS. 13A–13C. Pacifier 1220 is placed into an infant's mouth so that nipple 1200 is located between palate 8 and tongue 7, as shown in FIG. 13A. Abutment line 1250 is shown together. An abutment channel 1260 runs adjacent to the abutment forming a portion of the gap between wings 1210 and 1220. As tongue 7 moves upward and begins to apply pressure against nipple 1200, the nipple begins to compress between the tongue and palate 8. The compression causes wings 1210 and 1220 to expand outwardly from abutment line, increasing the size of abutment channel 1260 between the wings, as shown in FIG. 13B. As tongue 7 reaches a maximum pressure, as shown in FIG. 13C, nipple 1200 is fully compressed and wings 1210 and 1220 have expanded outwardly sufficiently to cause the abutment channel 1260 to reach all of the way up to the surface of palate 8. Such has the effect of preventing a vacuum between nipple 1200 and palate 8, and avoids the problems outlined above.

FIGS. 14A–14D show a further embodiment of a pacifier 1300 that, rather than using wings, has a series of channels to prevent a vacuum from forming between the pacifier 1300 and the infant's mouth. The shape of pacifier 1300 is similar to those shown in the previous embodiments. It has a nipple 1400 that has an elongated shape with a bulbous end 1470 and a stem portion 1480. Running through stem portion 1480 from a top surface to a bottom surface is a transverse hole 1450, which operates in a similar fashion as described above with reference to the other embodiments.

Running from transverse hole 1450 to the proximal end (relative to the interior of a user's mouth) of nipple 1400 through the bulbous end 1470 is a longitudinal channel 1460 communicating the transverse hole to the distal end of the nipple at exit hole 1440. Crossing the longitudinal channel 1460 about midway through bulbous end 1470 are opposed cross channels 1430 and 1435 extending from the longitudinal channel out from nipple 1400. A series of vent passageways 1410 and 1420 run from the upper surface of bulbous end 1470 of nipple 1400 and communicate with the longitudinal channel 1460. The series of channels throughout nipple 1400 allow for air to pass from the vent passageways 1410 and 1420, through longitudinal channel 1460 and out from inside the nipple through exit hole 1440, cross channels 1430 and 1435 and the transverse hole 1450. The air may pass in the other direction as well.

Figure 15A:
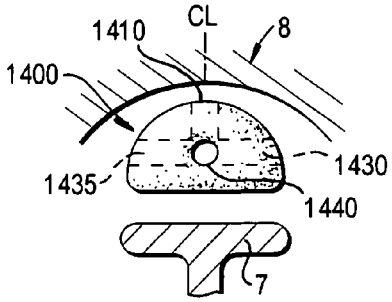
FIGS. 15A and 15B illustrate a sucking process using the pacifier shown in FIGS. 14A–14D.
Figure 15B:
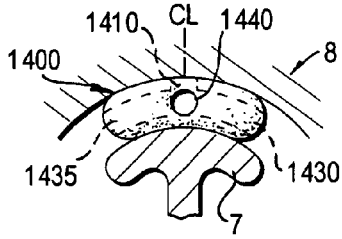

An operation of pacifier 1300 is shown in FIGS. 15A and 15B. Pacifier 1300 is placed into an infant's mouth so that nipple 1400 is located between palate 8 and tongue 7, as shown in FIG. 15A. Note the orientation of the channel system in pacifier 1300. Vent passageway 1410 is adjacent to palate 8. Exit channel 1440 and cross channels 1430 and 1435 are located between palate 8 and tongue 7. Upon pressure of tongue 7 against nipple 1400, the nipple is compressed between the tongue and palate 8. The vacuum that would normally exist between nipple 1400 and palate 8 is avoided via the channel system. As shown in FIG. 15B, vent passageway 1410 contacts palate 8 and communicates with the inside of the mouth via exit channel 1440 and cross channels 1430 and 1435, which allows air to exit or enter the space between nipple 1400 and the palate 8.

The design of nipple 1400 of pacifier 1300 also allows at least a portion of the nipple 1400 to contact the centerline CL of palate 8, between the vent passageways 1410, 1420. Such provides pressure against palate 8 not only at palate sides, but across the middle palate surface, which will avoid the consequences of pressing against only the sides of palate 8.

The nipple of pacifiers of the present invention may be a conventional shape, such as shown by of FIG. 1A but modified to have the wings, support section and longitudinal channel and, if desired, transverse channel of the present invention.

Although the description above refers to specific embodiments, it should be recognized that the invention should not limited to these embodiments. Other embodiments and modifications are possible to those having ordinary skill in the art to which this invention pertains. For example, the channel system as described above may have fewer or more channels as long as there are sufficient number and design to allow air into and out of the region between the palate and the pacifier during use. Further other designs for the wings according to the other embodiments are possible. It is intended that the invention should limited only by the claims appended hereto.

I claim:

1. A pacifier comprising:

a nipple for insertion into an infant's mouth having a stem portion and a bulbous end; and a shield attached to the stem portion of the nipple;

wherein the bulbous end comprises a pair of wings and a support portion, each wing comprising a respective upper surface comprising a convex portion for contacting a middle third of a palate of an infant's mouth, and the support portion forming an inner lower surface within the bulbous end, the support portion connecting lower portions of the wings, the pair of wings comprising opposed longitudinal sides extending downwardly from the respective wing upper surface to the support portion inner lower surface to define a longitudinal channel between the longitudinal sides, an upper portion of one said opposed longitudinal side abutting or adjacent an upper portion of another said opposed longitudinal side in an at rest position.

2. The pacifier according to claim 1, wherein the upper portions of the opposed longitudinal sides of the wings move away from each other upon compression of the nipple between each upper surface of the bulbous end and a lower outer surface of the bulbous end.

3. The pacifier according to claim 1, wherein, the opposed longitudinal sides are abutting or adjacent to be apart a distance "D" from 0 to about 3 mm in the at rest position.

4. The pacifier according to claim 1, wherein the longitudinal sidewalls define the longitudinal channel to have a curved longitudinal shape for contacting the upper surface of the respective wings with the midline of the palate.

5. The pacifier according to claim 1, wherein a portion of each wing contacts a portion of a midline of the palate when the pacifier contacts the palate.

6. The pacifier according to claim 1, wherein the longitudinal channel expands upon compression of the nipple between each upper surface of the bulbous end and a lower outer surface of the bulbous end.

7. The pacifier according to claim 1, wherein the wings of the nipple have hollow chambers therein.

8. The pacifier according to claim 7, wherein each hollow chamber is filled with one member selected from the group consisting of air, liquid and a gel.

9. The pacifier according to claim 1, wherein the support portion is solid.

10. The pacifier according to claim 1, wherein the support portion has a hollow chamber.

11. The pacifier according to claim 1, wherein the maximum distance between the longitudinal sides is 0 to 3 mm apart in the at rest position.

12. The pacifier according to claim 1, wherein opposed middle portions of the longitudinal sides are 0 to 3 mm apart in the at rest position.

13. The pacifier according to claim 1, wherein opposed middle portions of the longitudinal sides are about 0.5 to about 6 mm apart in an in use position.

14. The pacifier according to claim 1, wherein, the upper portion of each longitudinal wall comprises a shoulder.

15. The pacifier according to claim 1, wherein, a portion a lower surface of the pacifier bulbous end is concave.

16. The pacifier according to claim 1, wherein the stem portion comprises a transverse hole passing from an upper portion of the stem portion adjacent to the upper surface of the bulbous end to a lower portion of the stem portion.

17. A pacifier comprising: a nipple for insertion into an infant's mouth having a stem portion and a bulbous end; and a shield attached to the stem portion of the nipple; wherein the bulbous end comprises a pair of wings defining an upper surface for contacting a palate of an infant's mouth, and a support portion forming a lower surface thereof and connecting lower portions of the wings, the pair of wings having abutting or adjacent opposed longitudinal sides in an at rest position to define a longitudinal channel therebetween wherein the stem portion comprises a transverse hole passing from an upper portion of the stem portion adjacent to the upper surface of the bulbous end to a lower portion of the stem portion.

18. The pacifier according to claim 17, wherein the longitudinal channel opens into the transverse hole.

19. The pacifier according to claim 17, wherein, the transverse hole is a distance from about 3 mm to about 9 mm from the shield.

20. A pacifier comprising: a nipple for insertion into an infant's mouth having a stem portion and a bulbous end; and a shield attached to the stem portion of the nipple; wherein the bulbous end comprises a pair of wings defining an upper surface for contacting a palate of an infant's mouth, and a support portion forming a lower surface thereof and connecting lower portions of the wings, the pair of wings having abutting or adjacent opposed longitudinal sides in an at rest position to define a longitudinal channel therebetween, wherein the support portion has a hollow chamber, wherein a vent line extends from the hollow chamber of the support portion through the shield.

21. The pacifier according to claim 1, wherein the shield has a concave shape.

22. The pacifier according to claim 1, wherein the opposing longitudinal sides of the pair of wings are in an abutting relationship forming an abutment line in the at rest position.

23. The pacifier according to claim 22, wherein the abutment line has a curved longitudinal shape for contacting the upper surface of the respective wings with the midline of the palate.

24. The pacifier according to claim 23, wherein each wing upper surface comprises at least a portion for contacting a centerline of the palate when the bulbous end contacts the palate.

25. The pacifier according to claim 22, wherein the wings move away from each other upon compression of the nipple between the upper surface of the bulbous end and a lower surface of the bulbous end.

26. A pacifier comprising:

a. a nipple for insertion into an infant's mouth having a stem portion and a bulbous end;

b. a shield attached to the stem portion of the nipple; and c. a handle attached to the shield;

d. wherein the bulbous end has an upper surface for contacting a palate of the infant's mouth, wherein the bulbous end also has a vent hole on the upper surface and a longitudinal channel extending through the bulbous end having at least one exit hole on a side surface of the bulbous end and communicating with the vent hole.

27. The pacifier according to claim 26, wherein the stem portion comprises a transverse hole passing from an upper surface of the stem portion downwardly into the stem portion.

28. The pacifier according to claim 27, wherein the longitudinal channel communicates with the transverse hole.

29. The pacifier according to claim 26, wherein the stem portion comprises a transverse hole passing from an upper surface of the stem portion adjacent to the upper surface of the bulbous end to a lower surface of the stem portion.

30. The pacifier according to claim 26, wherein the exit hole is located on an end of the bulbous end distal from the shield.

31. The pacifier according to claim 26, wherein the exit hole is located on an end of the bulbous end distal from the shield.

32. The pacifier according to claim 26, wherein the bulbous end further has a pair of cross channels extending at an angle to the longitudinal channel and having cross channel exit holes on the side surface of the bulbous end.

33. The pacifier according to claim 32, wherein the shield has a concave shape.

34. The pacifier according to claim 26, wherein the upper surface of the bulbous end has a plurality of vent holes communicating with the longitudinal channel.

35. The pacifier according to claim 34, wherein each said hollow chamber is filled with a member selected from the group consisting of air, liquid and a gel.

36. The pacifier according to claim 26, wherein the bulbous end has hollow chambers therein.

* * * * *